US009885183B1

(12) United States Patent
Miner et al.

(10) Patent No.: US 9,885,183 B1
(45) Date of Patent: Feb. 6, 2018

(54) DE-ICING MATERIAL DISPENSER ATTACHMENT DEVICE AND METHOD OF USING THE SAME

(71) Applicants: Donald M. Miner, Framingham, MA (US); Brian D. Miner, Framingham, MA (US)

(72) Inventors: Donald M. Miner, Framingham, MA (US); Brian D. Miner, Framingham, MA (US)

( * ) Notice: Subject to any disclaimer, the term of this patent is extended or adjusted under 35 U.S.C. 154(b) by 0 days.

(21) Appl. No.: 15/468,330

(22) Filed: Mar. 24, 2017

Related U.S. Application Data

(60) Provisional application No. 62/319,000, filed on Apr. 6, 2016.

(51) Int. Cl.
*E04D 13/10* (2006.01)
*E04D 13/076* (2006.01)

(52) U.S. Cl.
CPC ..... *E04D 13/103* (2013.01); *E04D 13/106* (2013.01); *E04D 13/0762* (2013.01); *E04D 13/0765* (2013.01)

(58) Field of Classification Search
CPC . E04D 13/103; E04D 13/106; E04D 13/0762; E04D 13/0765
See application file for complete search history.

(56) References Cited

U.S. PATENT DOCUMENTS 3,989,925 A * 11/1976 Garner ..... E04D 13/103 126/271.1
6,851,582 B2 * 2/2005 Meyer ..... E04D 13/0762 222/174
6,964,353 B1 * 11/2005 Lamerson ..... E04D 13/0762 222/174
7,267,503 B1 * 9/2007 Bentsen ..... A46B 5/0033 401/123
2004/0256412 A1 * 12/2004 Meyer ..... E04D 13/0762 222/174
2006/0213133 A1 * 9/2006 Hale ..... E04D 13/0762 52/127.5
2006/0231575 A1 * 10/2006 Sroufe ..... E04D 13/106 222/174
2010/0025496 A1 * 2/2010 Fitzsimons ..... A01G 25/14 239/377
2016/0319549 A1 * 11/2016 Mansir ..... E04D 13/103

* cited by examiner

*Primary Examiner* — Frederick C Nicolas
(74) *Attorney, Agent, or Firm* — Law Office of Jerry Joseph, PLC; Jerry K. Joseph

(57) ABSTRACT

A dispenser attachment device configured to attach to a conventional snow roof rake tool having a handle, the dispenser attachment device including a reservoir compartment to store and release a de-icing material, an attachment member configured to detachably couple to the tool, and a stabilizer having an upper member and a lower member extending therefrom to stabilize the reservoir compartment when releasing the de-icing material, wherein the reservoir compartment stores the de-icing material when in a first position and dispenses the de-icing material when the reservoir compartment is rotated to a second position.

18 Claims, 12 Drawing Sheets

DE-ICING MATERIAL DISPENSER ATTACHMENT DEVICE AND METHOD OF USING THE SAME

CROSS-REFERENCE TO RELATED APPLICATIONS

This application claims the benefit of U.S. Provisional Patent Application No. 62/319,000 filed on Apr. 6, 2016, the disclosure of which is incorporated herein in its entirety by reference.

BACKGROUND OF THE INVENTION

1. Field of the Invention

The present general inventive concept relates to a de-icing material dispenser, and more particularly, to a de-icing material dispenser tool which attaches to a conventional hand tool, such as a snow roof rake.

2. Description of Related Art

Ice dams cause substantial damage to buildings in colder climate regions. An ice dam is a build-up of ice typically on slanted roofs of buildings which often causes water damage to the building. Ice dams form when accumulated snow on roofs melts and flows down the roof until it reaches the roof overhang which is colder than the upper roof and freezes thereby forming an ice dam. The ice dam captures subsequent melting snow and as the water level rises within the dam it can penetrate under the asphalt roofing shingles and flow into the structure and damage insulation, ceilings, walls, carpeting, flooring, wood work and cause other structural damage.

As a result, several techniques and tools have been developed to prevent or limit ice dams. For instance, a special tool referred to as a snow roof rake has been developed to assist in removing snow from roofs of buildings. However, in order to prevent ice dams, snow from the entire roof should be removed. Typically, the roof snow rake is used by the user while standing on the ground surrounding the structure and is limited to removing only the lower snow accumulation leaving the remainder of the roof covered in snow.

In addition, deicing chemicals such as ice melt have been developed which lower the freezing point of ice, thus causing the ice to melt. However, there is currently no tool which easily dispenses deicing material on roofs. Therefore, what is desired is a simple tool that may be used in conjunction with existing snow roof rakes to safely dispense deicing material on roof and gutter ice dams.

SUMMARY OF THE INVENTION

The foregoing and/or other aspects of the present general inventive concept may be achieved by providing a dispenser attachment device configured to attach to a tool having a handle, the dispenser attachment device includes a reservoir compartment to store and release a de-icing material, an attachment member configured to detachably couple to the tool, and a stabilizer having an upper member and a lower member extending therefrom to stabilize the reservoir compartment when releasing the de-icing material, wherein the reservoir compartment stores the de-icing material when in a first position and dispenses the de-icing material when the reservoir compartment is rotated to a second position.

The attachment member may further include a channel extending from a first surface of the reservoir compartment toward a second surface of the reservoir compartment to allow the tool handle to extend beneath the reservoir compartment to provide support.

The attachment member and the channel may be configured to detachably couple to a cylindrically shaped handle.

The attachment member may further include a flexible fastening member movable from a first position to a second position to secure the attachment member to the tool.

The attachment member may further include a fastening member to rigidly secure the flexible fastening member in the second position to fix the attachment member to the tool.

The fastening member may include one of a nut and bolt, a wing-nut and bolt, and a mechanical fastener.

The upper member of the stabilizer may couple to a first side of the tool and the lower member of the stabilizer may couple to a second side of the tool to stabilize the reservoir compartment when the reservoir compartment is rotated from the first position to the second position to dispense the de-icing material stored therein.

The upper and lower members of the stabilizer may be constructed with a friction material in order to be secured to the tool by friction.

The reservoir compartment may be defined by a first end, an opposing second end, opposing side walls, and a bottom wall.

The bottom wall may be formed in an arc-shape so as to completely dispense all of the de-icing material disposed within the reservoir compartment when the reservoir compartment is rotated from the first position to the second position.

The bottom wall may be formed in an arc-shape and extends beyond the reservoir compartment to prevent the de-icing material from spilling.

The reservoir compartment may include a top end which is open to an external environment to allow the de-icing material stored therein to be dispensed when rotated from the first position to the second position.

The upper member of the stabilizer may include an integrated spreader to evenly spread out the dispensed de-icing material.

The de-icing material may include one of calcium chloride, rock salt, a fluid including a non-toxic anti-freezing agent.

The foregoing and/or other aspects of the present general inventive concept may also be achieved by providing a method of using a dispenser attachment device configured to attach to a tool having a handle, the dispenser attachment device comprising a reservoir compartment to store and release a de-icing material, an attachment member configured to detachably couple to the tool, and a stabilizer having an upper member and a lower member extending therefrom to stabilize the reservoir compartment when releasing the de-icing material, wherein the reservoir compartment stores the de-icing material when in a first position and dispenses the de-icing material when the reservoir compartment is rotated to a second position, the method includes obtaining a tool having a handle portion and a rake portion having a first surface and a second surface, placing the attachment member on the handle portion, coupling the upper member to the first surface of the rake portion and the lower member to the second surface of the rake portion, attaching a fastening member on to the attachment member to secure the dispenser attachment device to the tool, filling the reservoir compartment with a de-icing material while in a first position, disposing the reservoir compartment over a desired location, and rotating the reservoir compartment to a second position by rotating the handle portion to dispense the de-icing material over the desired location.

The attachment member may further include a channel extending from a first surface of the reservoir compartment toward a second surface of the reservoir compartment to allow the handle to extend beneath the reservoir compartment to provide support.

The attachment member may further include a flexible fastening member movable from a first position to a second position to secure the attachment member to the tool.

The attachment member may further include a fastening member to rigidly secure the flexible fastening member in the second position to fix the attachment member to the tool.

The fastening member may include one of a nut and bolt, a wing-nut and bolt, and a mechanical fastener.

The upper member of the stabilizer may couple to a first side of the tool and the lower member of the stabilizer may couple to a second side of the tool to stabilize the reservoir compartment when the reservoir compartment is rotated from the first position to the second position to dispense the de-icing material stored therein.

The upper and lower members of the stabilizer may be constructed with a friction material in order to be secured to the tool by friction.

The reservoir compartment may be defined by a first end, an opposing second end, opposing side walls, and a bottom wall.

The bottom wall may be formed in an arc-shape so as to aid in dispensing all the ice melt material from the reservoir compartment during the dispensing action.

The upper member of the stabilizer may include an integrated spreader to evenly spread out the dispensed de-icing material.

The de-icing material may include one of calcium chloride, rock salt, a fluid including a non-toxic anti-freezing agent.

BRIEF DESCRIPTIONS OF THE DRAWINGS

These and/or other aspects of the present general inventive concept will become apparent and more readily appreciated from the following description of the embodiments, taken in conjunction with the accompanying drawings of which:

DESCRIPTION OF INVENTION

The present general inventive concept provides a de-icing material dispenser which may be attached to a conventional snow roof rake. In an exemplary embodiment of the present general inventive concept, the de-icing material dispenser includes a de-icing material storage compartment to store the de-icing material and an attachment member used to attach the de-icing material dispenser to the conventional snow roof rake. In alternative exemplary embodiments, the de-icing material storage compartments may further include chambers that are separated by removable dividers to control weight distribution of the de-icing material placed in the storage compartments.

The de-icing material dispenser attachment device also referred herein to as "ice melt caddy", "snow rake buddy", "ice melt buddy", or "snow rake caddy" may be embodied in various shapes and sizes to correspond with various shapes and sizes of snow roof rakes. The de-icing material dispenser attachment device according to the present general inventive concept may be configured to be assembled and/or manufactured to be affixed to a plurality of snow roof rakes. In exemplary embodiments, the de-icing material may include calcium chloride, rock salt, or a fluid including a non-toxic anti-freezing agent. However, the present general inventive concept is not limited thereto.

Figure 1:
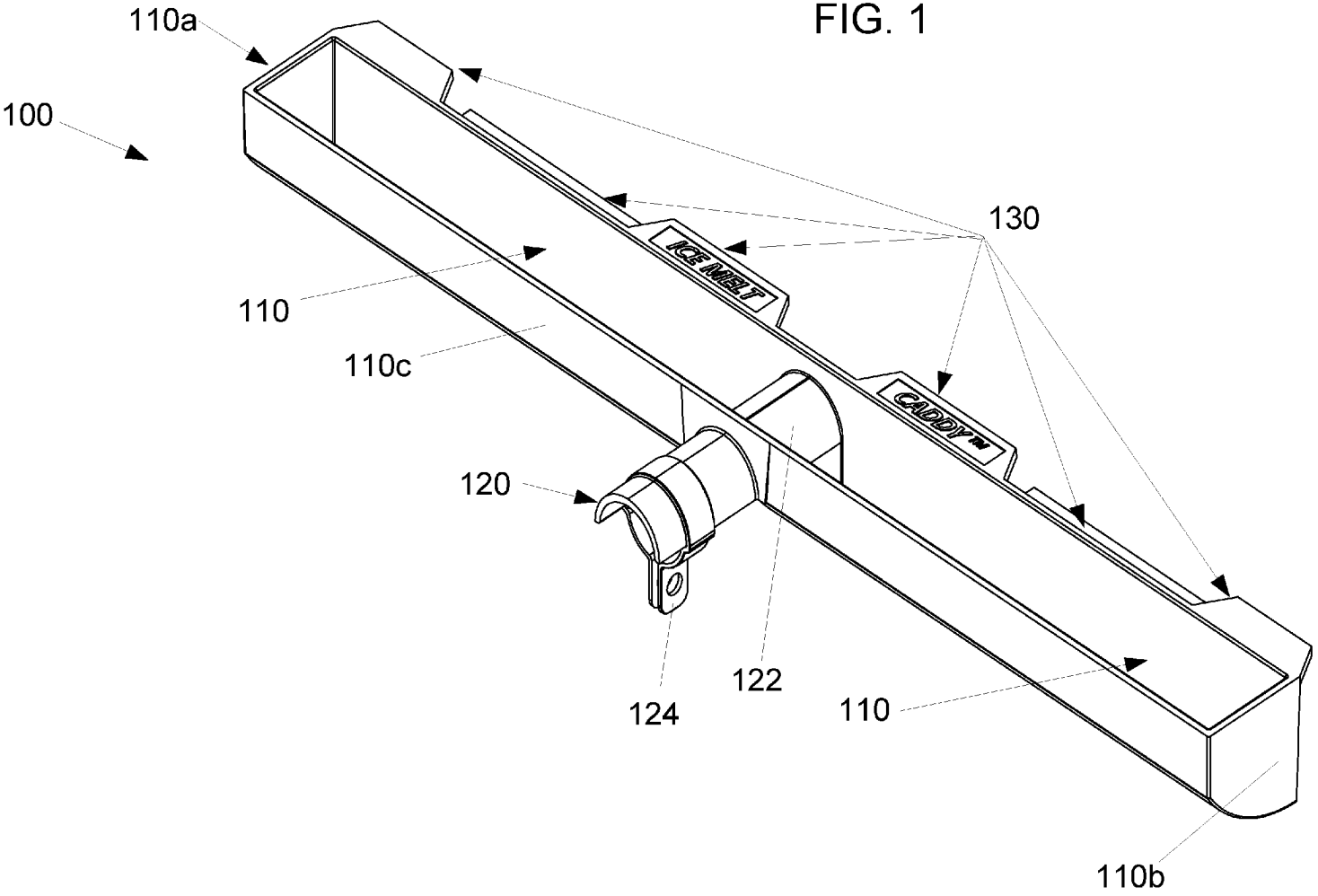
FIG. 1 illustrates a front perspective view of a de-icing material dispenser attachment device according to an exemplary embodiment of the present general inventive concept.
Figure 2:
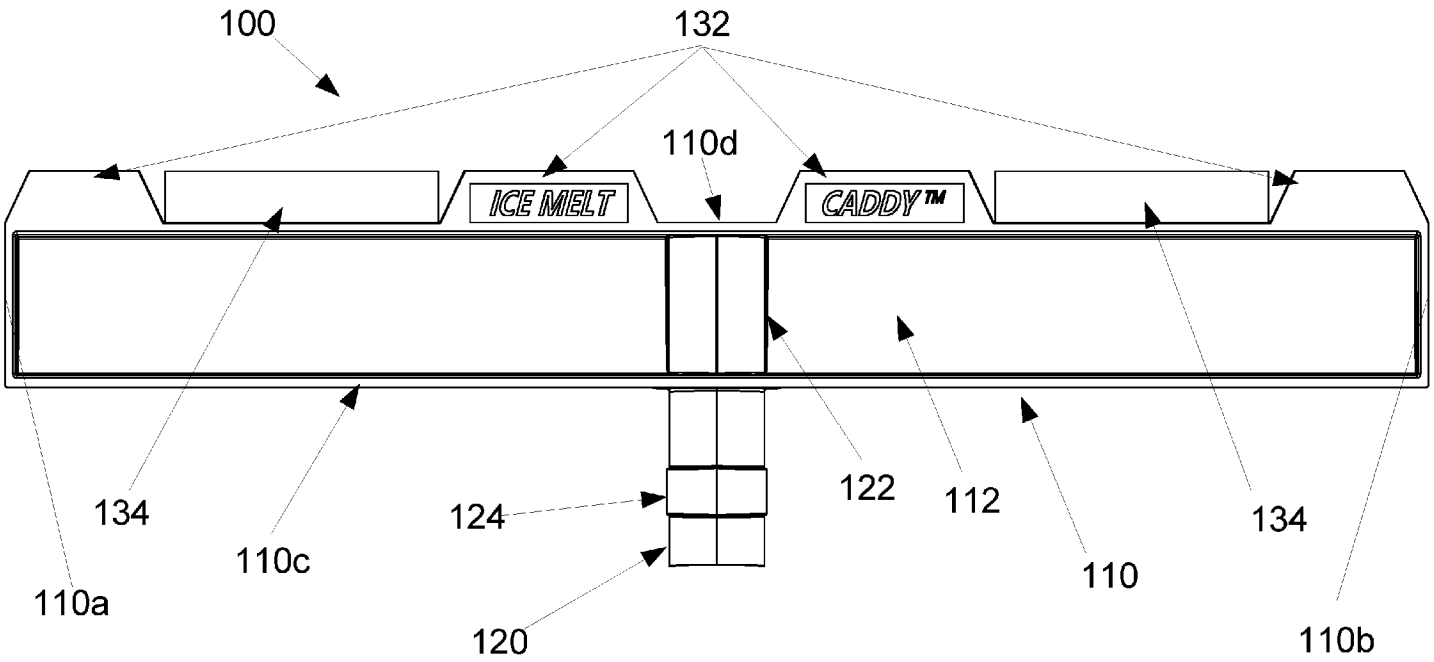
FIG. 2 illustrates a top plan view of the de-icing material dispenser attachment device illustrated in FIG. 1.
Figure 3:
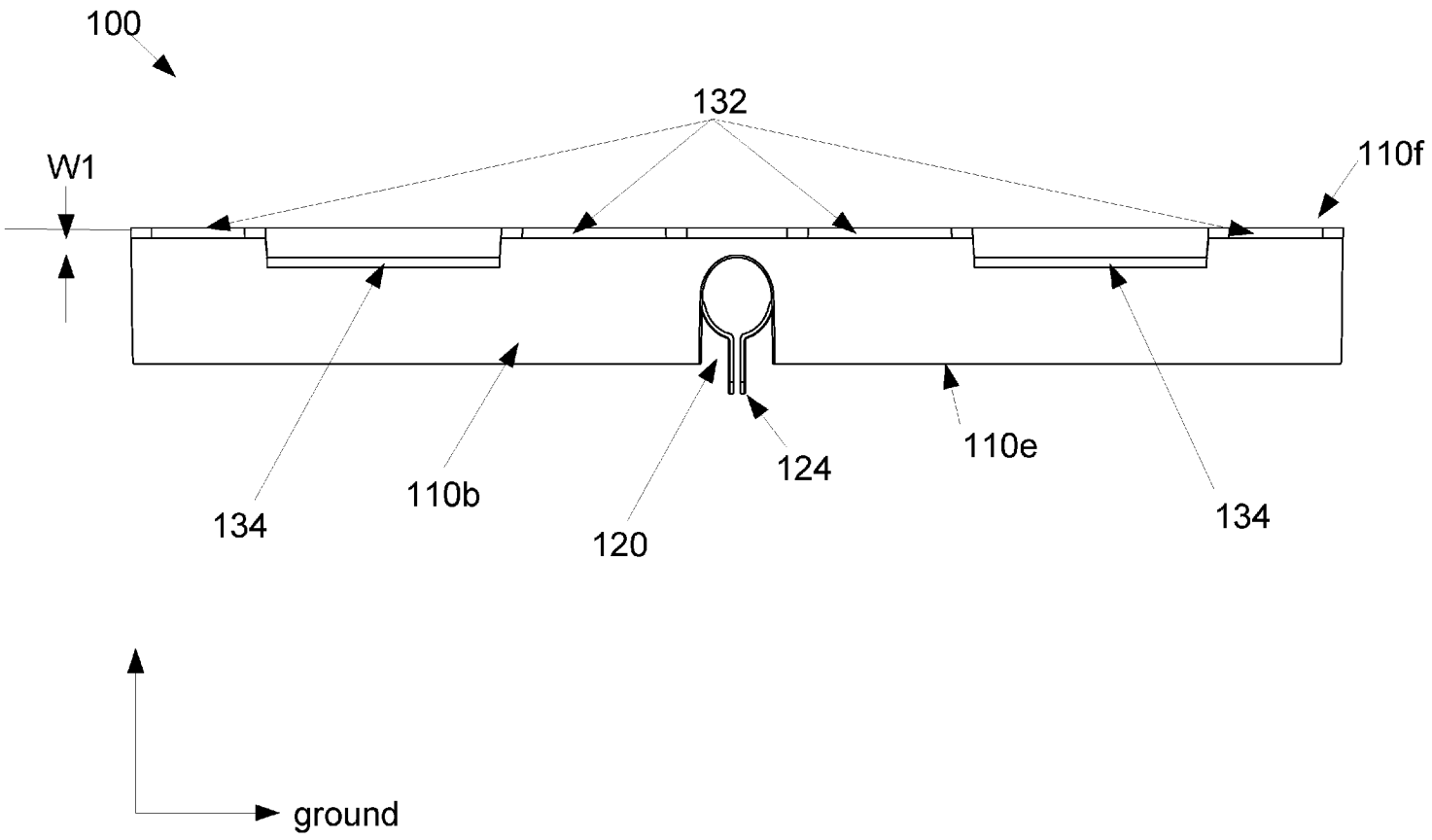
FIG. 3 illustrates a front view of the de-icing material dispenser attachment device illustrated in FIG. 1.
Figure 4A:
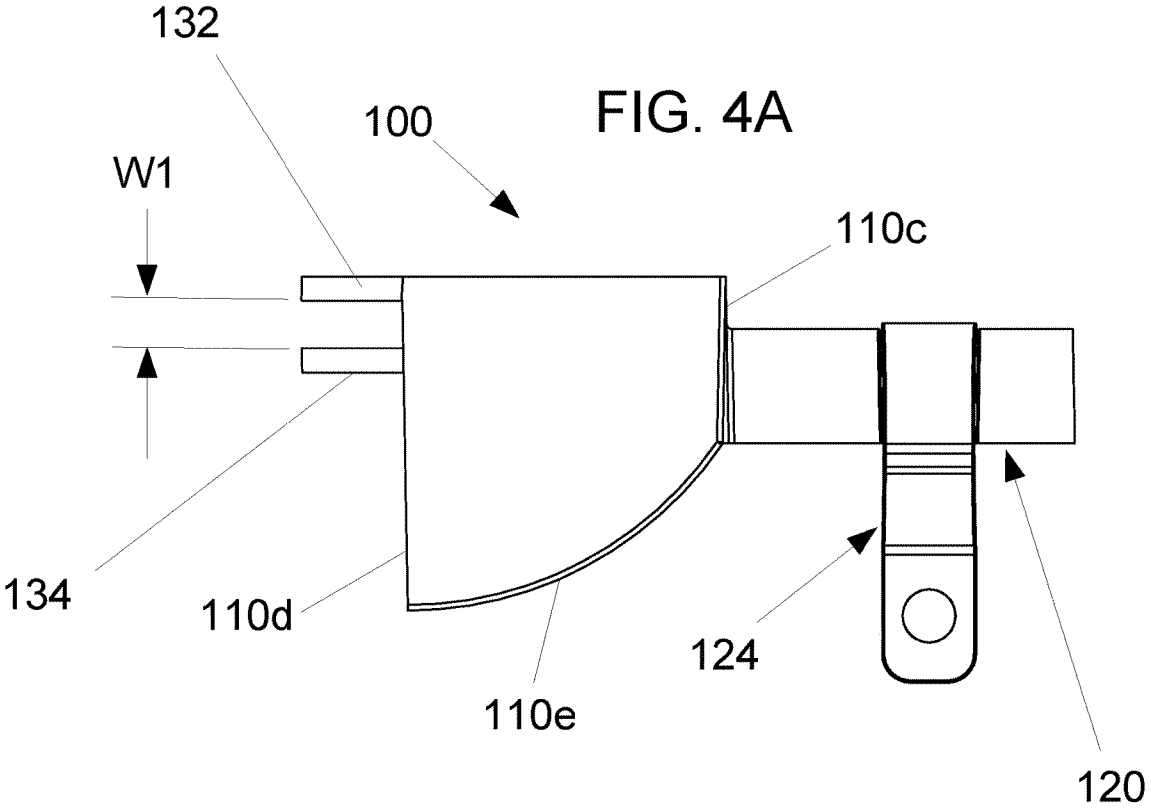
FIGS. 4A and 4B illustrates a left and right side views, respectively, of the de-icing material dispenser attachment device illustrated in FIG. 1.
Figure 4B:
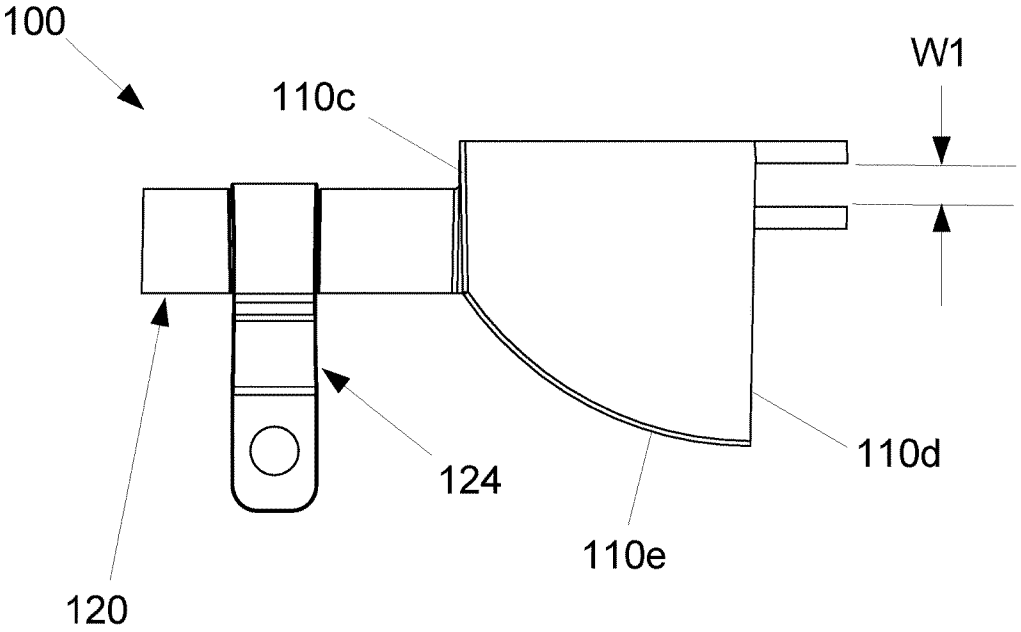
Figure 5A:
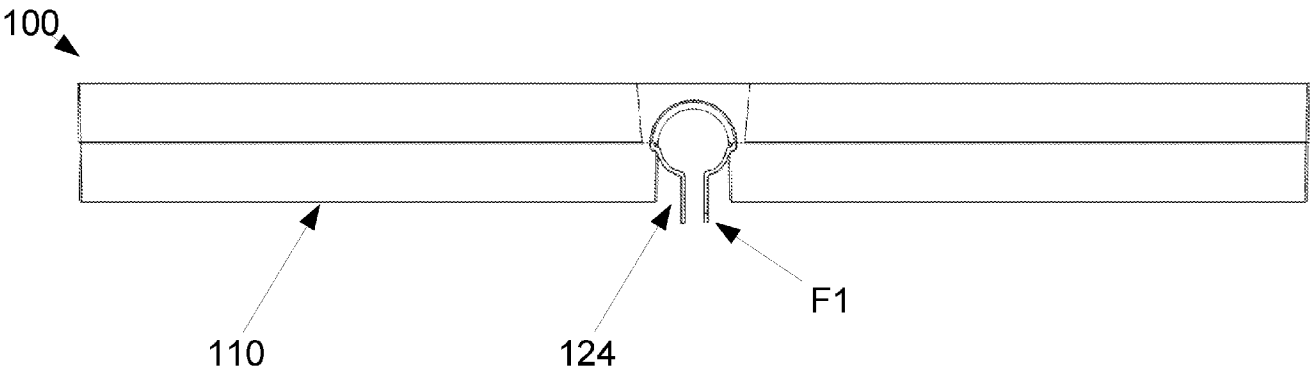
FIG. 5 illustrates a back plan view of the de-icing material dispenser attachment device illustrated in FIG. 1.
Figure 5B:
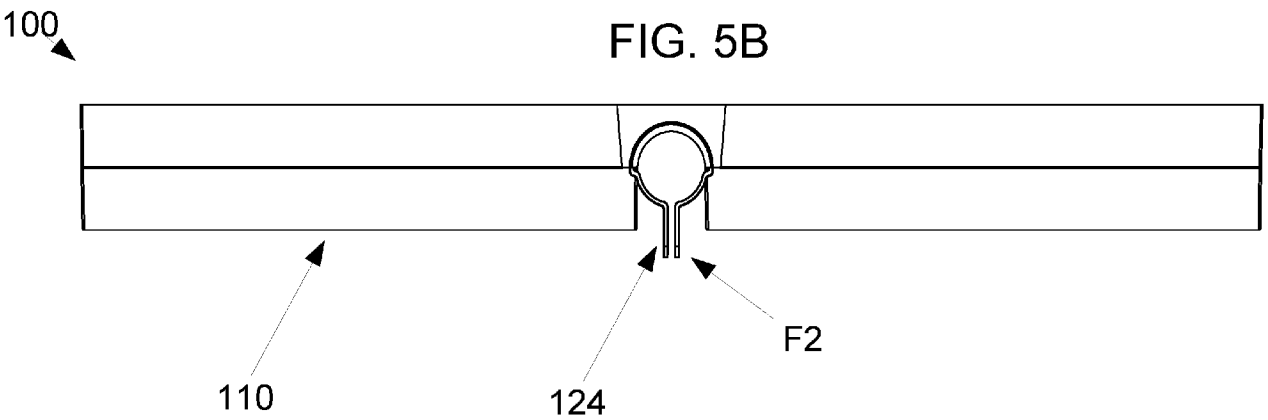
Figure 6:
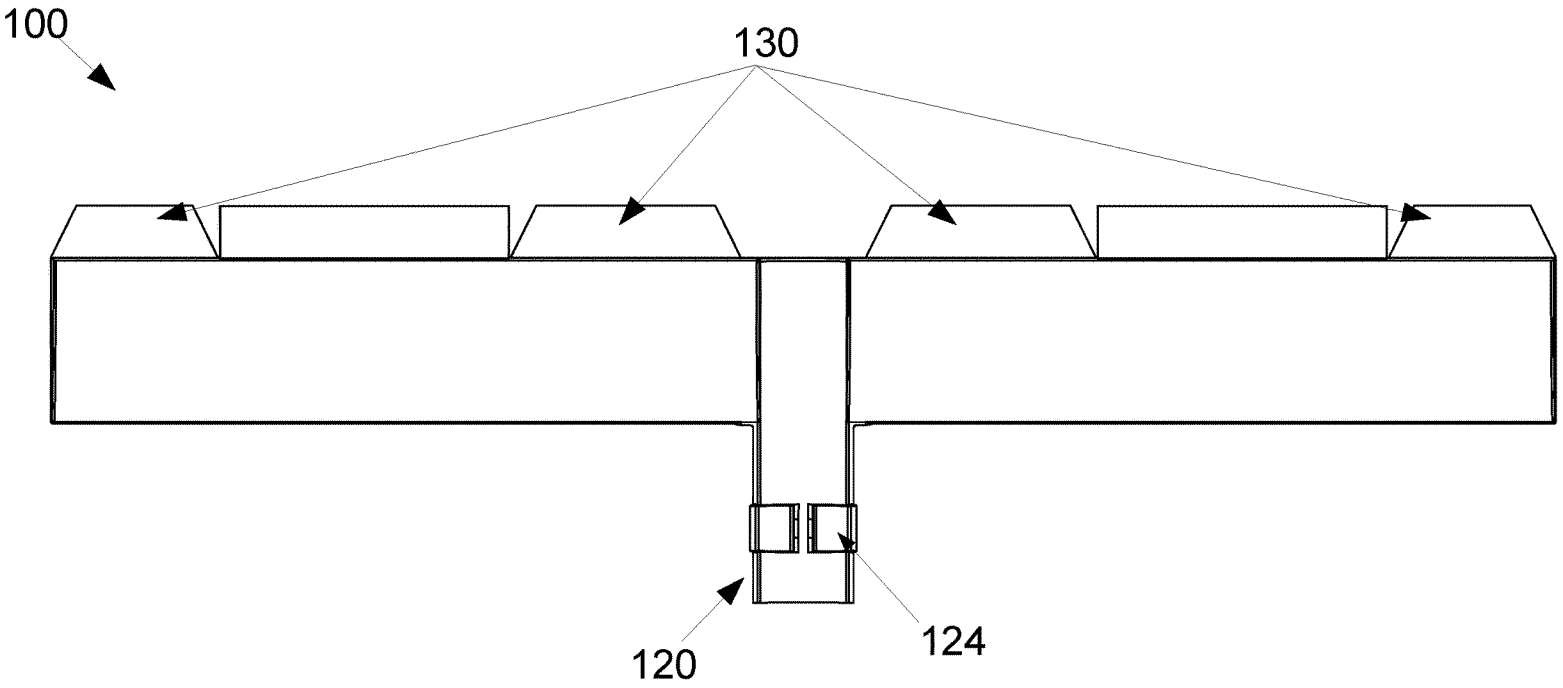
FIG. 6 illustrates a bottom plan view of the de-icing material dispenser attachment device illustrated in FIG. 1.
Figure 7:
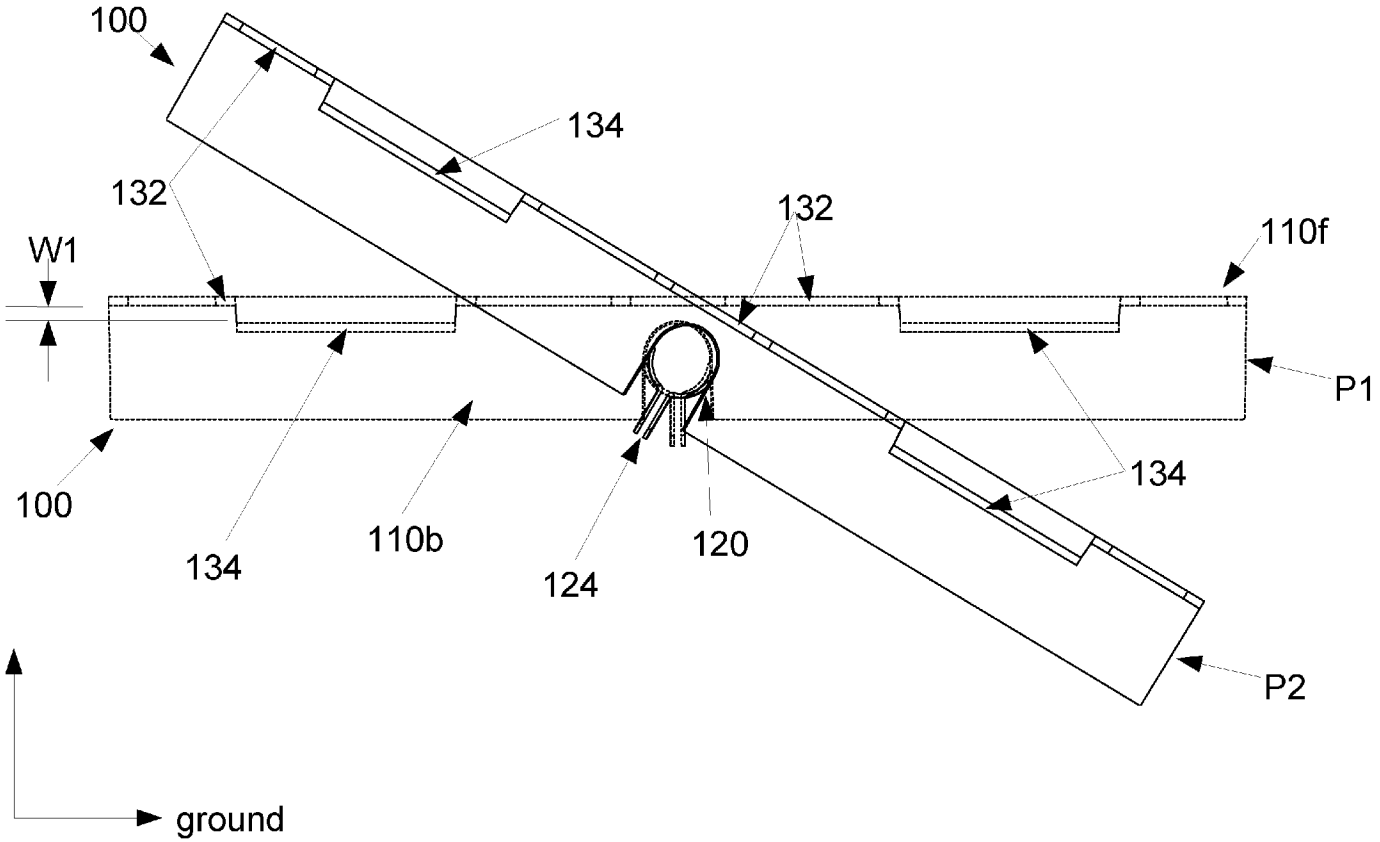
FIG. 7 illustrates a front view of the de-icing material dispenser attachment device illustrated in FIG. 1, disposed in a first and second position.
Figure 8A:
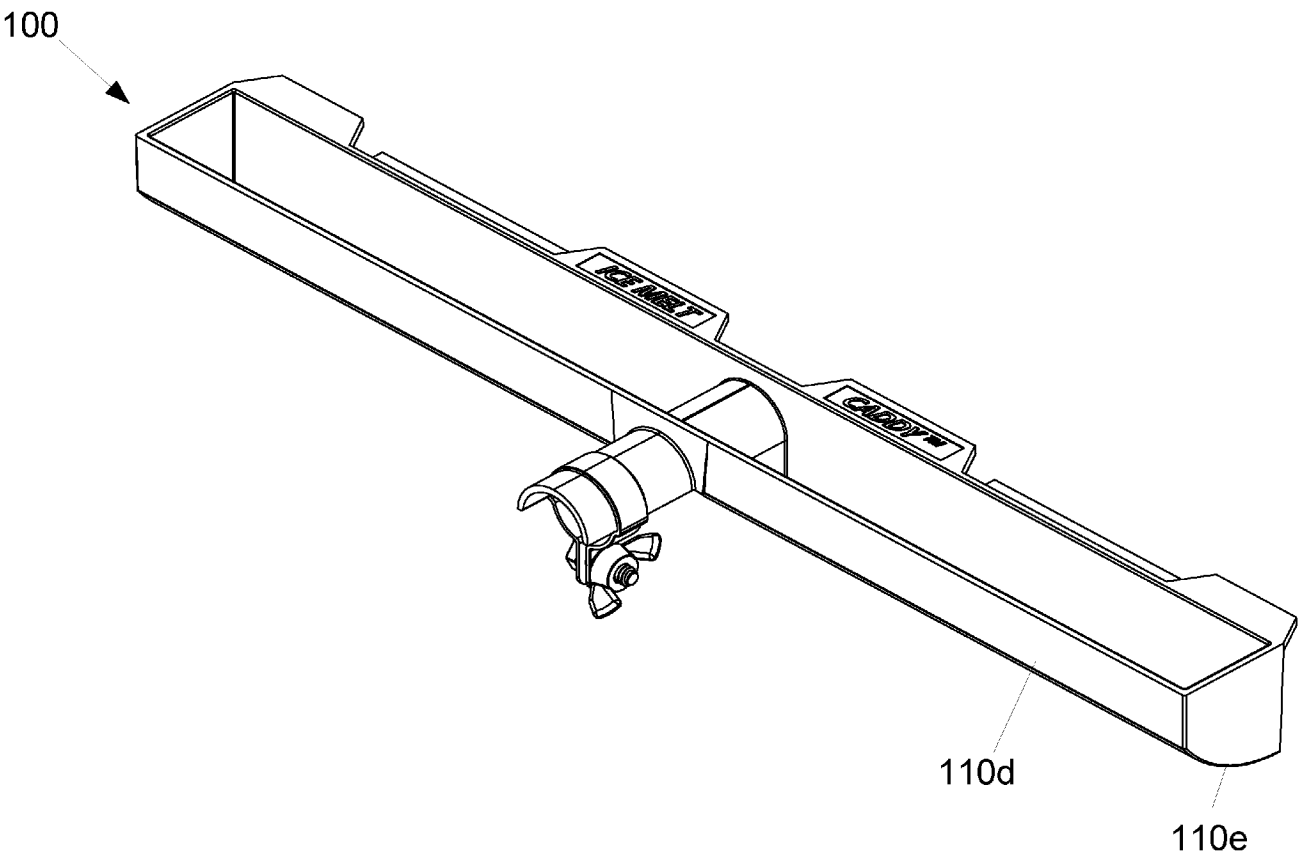
FIGS. 8A-8D illustrates a method of assembling and using a de-icing material dispenser attachment device, according to an exemplary embodiment of the present general inventive concept.
Figure 8B:
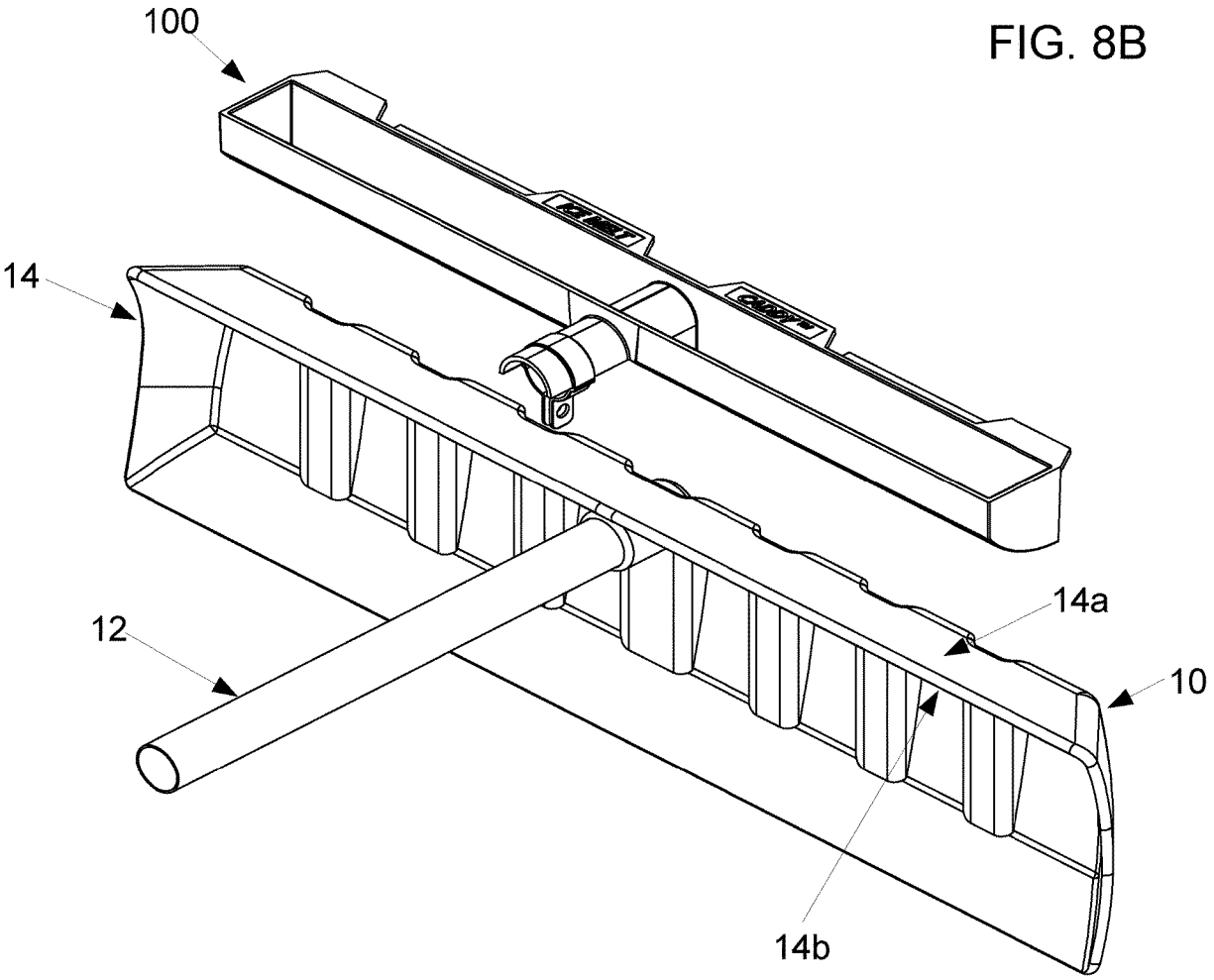
Figure 8C:
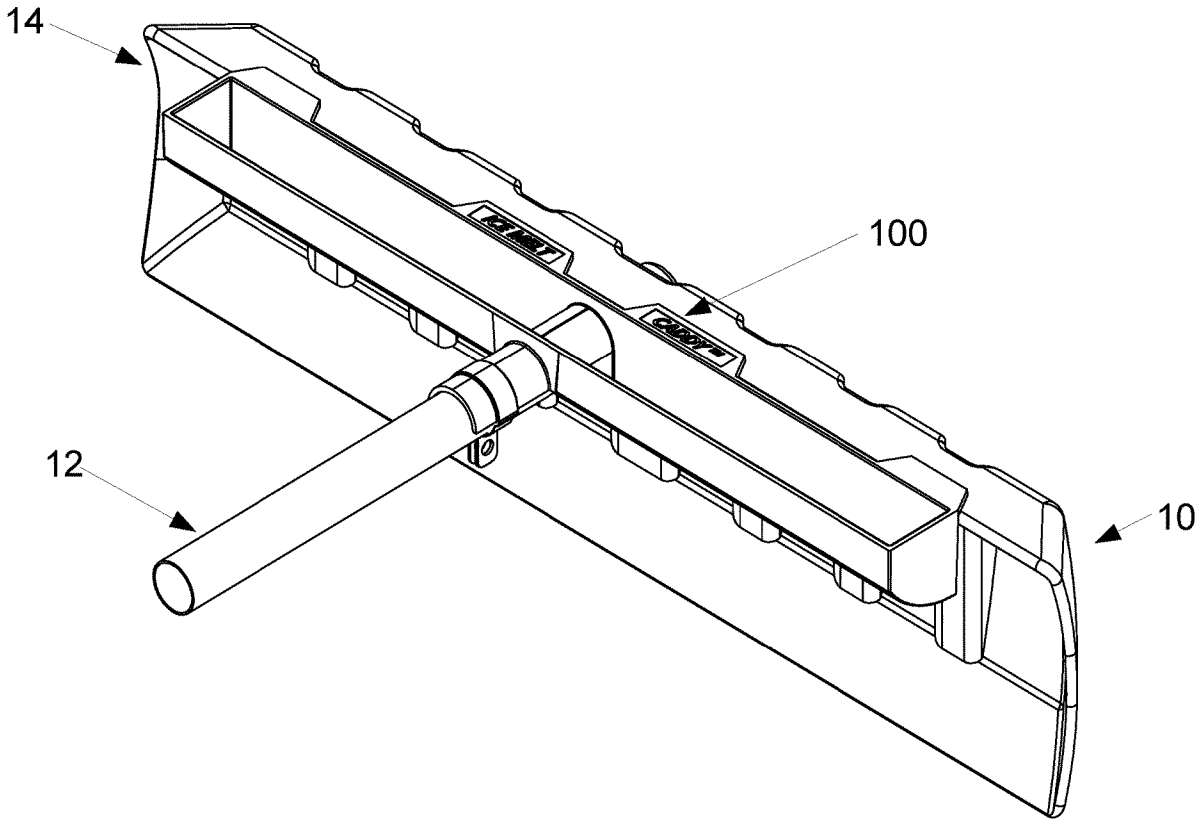
Figure 8D:
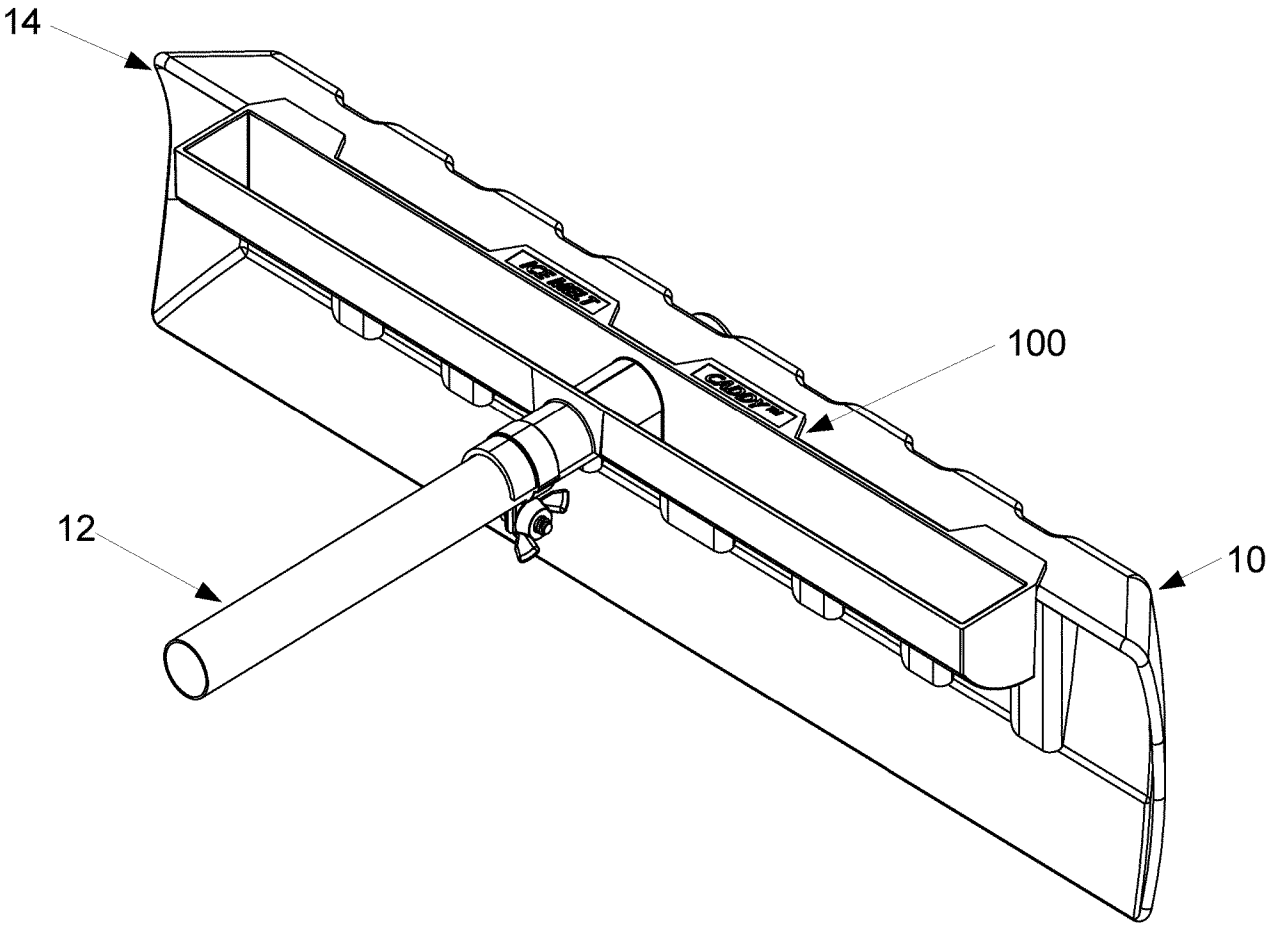

FIG. 1 illustrates a front perspective view of a de-icing material dispenser attachment device 100 according to an exemplary embodiment of the present general inventive concept. FIG. 2 illustrates a top plan view of the de-icing material dispenser attachment device 100 illustrated in FIG. 1. FIG. 3 illustrates a front view of the de-icing material dispenser attachment device 100 illustrated in FIG. 1 and FIGS. 4A and 4B illustrates a left and right side views, respectively, of the de-icing material dispenser attachment device illustrated in FIG. 1.

Referring to FIGS. 1 through 4, the de-icing material dispenser attachment device, designated generally as 100, is illustrated. In the present embodiment, the dispenser attachment device 100 includes a reservoir compartment 110 that is used to store and selectively release a de-icing material or the like, an attachment member 120 that is configured to detachably couple to or attach to a handle portion of a variety of tools 10 such as a snow roof rake, and a stabilizer 130 having an upper member 132 and a lower member 134 extending from the reservoir compartment 110 in order to stabilize the reservoir compartment 110 with respect to the tool 10, when dispensing and/or releasing the de-icing material stored within the reservoir compartment 110.

In the present exemplary embodiment, the dispenser attachment device 100 is configured to attach to a snow roof rake tool 10 which includes a rake portion 14 that is used to remove snow or debris from a user's roof and a handle portion 12 which is held by the user to extend a reach of the tool 10. The dispenser attachment device 100 includes a reservoir compartment 110 that may be used to store and selectively release a de-icing material or the like that is stored within the reservoir compartment 110.

In the present exemplary embodiment, the attachment member 120 is configured to be detachably coupled to the handle portion 12 of the tool 10 and the stabilizer 130 is configured to be detachably coupled to the rake portion 14 of the tool 10. However, the present general inventive concept is not limited thereto.

That is, in exemplary embodiments, the attachment member 120 may be sized and/or shaped so as to correspond or match a shape of the handle portion 12 of a desired tool. For instance, the attachment member 120 may have a circular cross-section in order to correspond to or match a circular handle portion 12 of a snow roof rake tool 10. However, the present general inventive concept is not limited thereto. That is, in alternative exemplary embodiments, the attachment member 120 may have a cross-section of various shapes in order to be coupled to the handle portions 12 having various shapes.

In the present exemplary embodiment, the stabilizer 130 includes an upper stabilizer member 132 and a lower stabilizer member 134 which extend from a surface of the reservoir compartment 110 to help stabilize the reservoir compartment 110. The stabilizer 130 further includes a gap or spacing (i.e., width W1) disposed between the upper and lower members 132, 134 in order to accommodate or fit around the rake portion 14 of the tool 10. That is, in the present embodiment, the upper stabilizer members 132 contact and couple to a first surface 14*a* (i.e., upper) of the rake portion 14 and the lower stabilizer members 134 contact and couple to a second surface 14*b* (i.e., lower) of the rake portion 14 in order to provide support and stability to the dispenser attachment device 100 when the reservoir compartment 110 is rotated from the first position toward the second position, while dispensing the de-icing material stored therein.

In the present exemplary embodiment, the reservoir compartment 110 is defined by a first end wall 110*a*, an opposing second end wall 110*b*, opposing side walls 110*c* and 110*d*, and a bottom wall 110*e*. As such, the first end wall 110*a*, the opposing second end wall 110*b*, the opposing side walls 110*c* and 110*d*, and the bottom wall 110*e* define a compartment in which the de-icing material may be stored.

In exemplary embodiments, the bottom wall 110*e* is formed in an arc-shape so as to allow ice melt or other snow melt material to be fully discharged during the dispensing rotation action from the reservoir compartment 110.

In the present exemplary embodiment, the reservoir compartment 110 includes a top end 110*f* which is open to an external environment to allow the de-icing material stored therein to be dispensed when rotated. That is, the reservoir compartment 110 is configured to store the de-icing material when in a first position P1, when the top end 110*f* of reservoir compartment 110 is substantially horizontal with respect to the ground. Conversely, the reservoir compartment 110 is configured to dispense the de-icing material stored therein when rotated to a second position P2, wherein the top end 110*f* of the reservoir compartment 110 is inclined with respect to the ground. As a result, when the reservoir compartment 110 is rotated from the first position P1 (i.e., storage position) to the second position P2 (i.e., dispense position), gravity forces the de-icing material stored within the reservoir compartment 110 outside of the reservoir compartment 110 in to the external environment.

In exemplary embodiments, the attachment member 120 may further include a channel 122 which extends between the opposing side walls 110*c* and 110*d* of the reservoir compartment 110 to allow the handle portion of the tool 10 to extend beneath the reservoir compartment 110 to provide stability and support. The channel 122 may include a circular cross-section to receive a cylindrically shaped handle portion 12 of the tool 10. However, the present general inventive concept is not limited thereto.

In the present embodiment, the attachment member 120 may further include a flexible fastening member 124 which is movable between a first position F1 to a second position F2 in order to securely fasten the attachment member 120 to the handle portion 12 of the tool 10.

In alternative exemplary embodiments, the attachment member 120 may further include various types of fasteners to rigidly fasten and secure the flexible fastening member 124 in the second position F2 in order to fix the attachment member 120 to the tool 10. However, the present general inventive concept is not limited thereto. That is, in alternative embodiments, the fastening member may include a nut and bolt, a wing-nut and bolt, or various other conventionally known mechanical fasteners.

In the present embodiment, the upper member 132 of the stabilizer 130 couples to a first side of the tool 10 and the lower member 134 of the stabilizer 130 couples to a second side of the tool 10 to stabilize the reservoir compartment 110 when the reservoir compartment 110 is rotated from the first position P1 to the second position P2 to dispense the de-icing material stored therein. The upper and lower members of the stabilizer may be constructed with a friction material to improve the stability of the dispenser attachment device during ice melt discharge.

In alternative exemplary embodiments, the upper member 132 of the stabilizer 130 includes an integrated spreader (not illustrated) to evenly spread out the de-icing material dispensed onto the external environment.

In the present exemplary embodiment, the attachment member 120 is designed and/or configured to be coupled to the handle of a conventional snow roof rake. However, the present general inventive concept is not limited thereto. In alternative exemplary embodiments, the attachment member 120 may be designed and/or configured to be coupled to a variety of snow roof rake tools having handles of various shapes and sizes.

In the present exemplary embodiment, the reservoir compartment 110 may be formed in a rectangular shape having a first end 110*a*, an opposing second end 110*b*, a first side wall 110*c*, an opposing second side wall 110*d*, and a bottom 110*e*. The first end 110*a*, the second end 110*b*, the first side wall 110*c*, the second side wall 110*d*, and the bottom 110*e* define a reservoir or storage compartment area, in which a de-icing material may be stored. In the present embodiment, the top end of reservoir compartment 110 is open to an external environment to allow the de-icing material stored within the reservoir 110 to be dispensed. The dispenser attachment device 100 may be constructed from an impact-resistant plastic, such as polypropylene, polyethylene, polyvinyl chloride, or various other impact or temperature resistant plastic. However, the present general inventive concept is not limited thereto. That is, in alternative embodiments, the dispenser attachment device 100 may be constructed from a plurality of lightweight materials, including plastics, metals, graphite, or carbon fiber.

The one or more storage reservoirs 110 include at least one chamber 112 to store a deicing material; a stabilizer to help support the storage compartment on a conventional snow roof rake; and an attachment member including an attachment bolt and attachment wing nut to detachably secure the de-icing material dispenser attachment device to the conventional snow roof rake.

FIGS. 8A-8D illustrate a method of assembling and using a de-icing material dispenser attachment device 100, according to an exemplary embodiment of the present general inventive concept.

In operation, the dispenser attachment device 100 may be configured and designed to be fixed onto the handle of a conventional snow roof rake. According to an exemplary embodiment, the dispenser attachment device 100 may be used as follows.

Referring to FIGS. 8A-8D, once a desired snow rake tool 10 having a handle portion 12 and a rake portion 14 having a first surface 14*a* and a second surface 14*b* is obtained, the attachment member 110 is aligned to and placed onto the handle portion 12 of the tool. Next, the upper member 132 of the stabilizer 130 is coupled to the first surface 14*a* of the rake portion 14 and the lower member 134 of the stabilizer 130 is coupled to the second surface 14*b* of the rake portion 14. The upper and lower members 132, 134 may be constructed with a friction material to allow the dispenser attachment device 100 to be better secured to the tool by friction. Next, a fastening member 124 is attached onto the attachment member 120 to secure the dispenser attachment device 100 to the tool 10. However, the present general inventive concept is not limited thereto. That is, in alternative embodiments, various other types of mechanical fastening means may be used to attach the dispenser attachment device 100 to the tool 10.

Next, while the reservoir compartment 110 is substantially parallel to the ground (i.e., a first position), a user may fill or partially fill the reservoir compartment 110 with a de-icing material. A user may then extend the reservoir compartment 110 filled with the de-icing material over a desired location, such as a house roof or gutters, by using the handle portion 12 of the tool 10. Next, the user may selectively dispense the contents of the reservoir compartment 110 over a desired location by rotating the handle portion 12 such that the reservoir compartment 110 is inclined with respect to the ground (i.e., a second position). As a result, gravity will force the de-icing material from the reservoir compartment 110 onto the user's desired location. That is, by rotating the reservoir compartment 110 to the second position by rotating the handle portion 12, the de-icing material stored within the reservoir compartment 110 is dispensed to an external environment over the desired location.

The dispenser attachment device according to the present general inventive concept is specifically designed and configured to be coupled to a wide variety of conventional snow roof rakes. However, the present general inventive concept is not limited thereto. In exemplary embodiments, the attachment member may be detachably fastened or integrally formed to a head of the snow roof rake. The attachment member may further include a non-slip friction coating to help secure the dispenser attachment device to the handle of the snow roof rake or other tool. Once attached, a user may place a de-icing material, such as ice melt, into the storage compartment. The user may then position the reservoir compartment 110 filled with the de-icing material over any location on a roof or gutters that the conventional snow roof rake may reach.

The user may then dispense the de-icing material onto a desired location by simply tipping the snow roof rake with attached storage compartment to either the left or the right, which thereby allows the de-icing material be released by gravity from the storage compartment. The stabilizer member is a channeled protrusion from the front of the storage compartment of the de-icing material dispenser attachment device to help support and/or stabilize the storage compartment when filled with de-icing material. The stabilizer member engages above and below the top front ridge of the snow roof rake to help secure it to the snow roof rake. The upper and lower stabilizer members may utilize a non-slip friction coating to help secure the dispenser attachment member to the snow roof rake tool.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A dispenser attachment device configured to attach to a tool having a handle, the dispenser attachment device comprising:

a reservoir compartment to store and release a de-icing material;

an attachment member configured to detachably couple to the tool; and a stabilizer having an upper member and a lower member extending therefrom to stabilize the reservoir compartment when releasing the de-icing material, the upper member coupled to a first side of the tool and the lower member coupled to a second side of the tool to stabilize the reservoir compartment when the reservoir compartment is rotated from the first position to the second position, wherein the reservoir compartment stores the de-icing material when in a first position and dispenses the de-icing material when the reservoir compartment is rotated to a second position.

2. The dispenser attachment device of claim 1, wherein the attachment member further includes a channel extending from a first surface of the reservoir compartment toward a second surface of the reservoir compartment to allow the tool handle to extend beneath the reservoir compartment to provide support.

3. The dispenser attachment device of claim 2, wherein the attachment member and the channel are configured to detachably couple to a cylindrically shaped handle.

4. The dispenser attachment device of claim 3, wherein the attachment member further includes a flexible fastening member movable from a first position to a second position to secure the attachment member to the tool.

5. The dispenser attachment device of claim 4, wherein the attachment member further includes a fastening member to rigidly secure the flexible fastening member in the second position to fix the attachment member to the tool.

6. The dispenser attachment device of claim 5, wherein the fastening member includes one of a nut and bolt, a wing-nut and bolt, and a mechanical fastener.

7. The dispenser attachment device of claim 1, wherein the upper and lower members of the stabilizer are constructed with a friction material in order to be secured to the tool by friction.

8. The dispenser attachment device of claim 1, wherein the reservoir compartment is defined by a first end, an opposing second end, opposing side walls, and a bottom wall.

9. The dispenser attachment device of claim 8, wherein the bottom wall is formed in an arc-shape so as to completely dispense all of the de-icing material disposed within the reservoir compartment when the reservoir compartment is rotated from the first position to the second position.

10. The dispenser attachment device of claim 8, wherein the bottom wall is formed in an arc-shape and extends beyond the reservoir compartment to prevent the de-icing material from spilling.

11. The dispenser attachment device of claim 8, wherein the reservoir compartment includes a top end which is open to an external environment to allow the de-icing material stored therein to be dispensed when rotated to the second position.

12. The dispenser attachment device of claim 1, wherein the upper member of the stabilizer includes an integrated spreader to evenly spread out the dispensed de-icing material.

13. The dispenser attachment device of claim 1, wherein the de-icing material includes one of calcium chloride, rock salt, a fluid including a non-toxic anti-freezing agent.

14. A method of using a dispenser attachment device configured to attach to a tool having a handle, the dispenser attachment device comprising a reservoir compartment to store and release a de-icing material, an attachment member configured to detachably couple to the tool, and a stabilizer having an upper member and a lower member extending therefrom to stabilize the reservoir compartment when releasing the de-icing material, wherein the reservoir compartment stores the de-icing material when in a first position and dispenses the de-icing material when the reservoir compartment is rotated to a second position, the method comprising:

obtaining a tool having a handle portion and a rake portion having a first surface and a second surface;

placing the attachment member on the handle portion;

coupling the upper member to the first surface of the rake portion and the lower member to the second surface of the rake portion;

attaching a fastening member on to the attachment member to secure the dispenser attachment device to the tool;

filling the reservoir compartment with a de-icing material while in a first position;

disposing the reservoir compartment over a desired location; and rotating the reservoir compartment to a second position by rotating the handle portion to dispense the de-icing material over the desired location.

15. The method of claim 14, wherein the upper member of the stabilizer couples to a first side of the tool and the lower member of the stabilizer couples to a second side of the tool to stabilize the reservoir compartment when the reservoir compartment is rotated from the first position to the second position to dispense the de-icing material stored therein.

16. The method of claim 14, wherein the bottom wall is formed in an arc-shape so as to aid in dispensing all the ice melt material from the reservoir compartment during the dispensing action.

17. The method of claim 14, wherein the upper member of the stabilizer includes an integrated spreader to evenly spread out the dispensed de-icing material.

18. The method of claim 14, wherein the de-icing material includes one of calcium chloride, rock salt, a fluid including a non-toxic anti-freezing agent.

* * * * *